US010014605B2

(12) United States Patent
Dekoski et al.

(10) Patent No.: US 10,014,605 B2
(45) Date of Patent: Jul. 3, 2018

(54) ELECTRICAL CONNECTOR WITH TERMINAL HOLDER

(71) Applicant: Molex, LLC, Lisle, IL (US)

(72) Inventors: Kurt Dekoski, Macomb, MI (US); David Langolf, Ortonville, IL (US); David Jennings, Lincoln, NE (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/312,767

(22) PCT Filed: May 27, 2015

(86) PCT No.: PCT/US2015/032669
§ 371 (c)(1),
(2) Date: Nov. 21, 2016

(87) PCT Pub. No.: WO2015/183951
PCT Pub. Date: Dec. 3, 2015

(65) Prior Publication Data

US 2017/0187139 A1 Jun. 29, 2017

Related U.S. Application Data

(60) Provisional application No. 62/005,279, filed on May 30, 2014.

(51) Int. Cl.
*H01R 12/58* (2011.01)
*H01R 13/506* (2006.01)
(Continued)

(52) U.S. Cl.
CPC ..... *H01R 12/585* (2013.01); *H01R 4/48* (2013.01); *H01R 9/092* (2013.01); *H01R 12/716* (2013.01);
(Continued)

(58) Field of Classification Search
CPC ..... H01R 12/585; H01R 9/092
See application file for complete search history.

(56) References Cited

U.S. PATENT DOCUMENTS 4,550,962 A * 11/1985 Czeschka ..... H01R 12/585 29/739
5,419,720 A 5/1995 Chen
(Continued)

FOREIGN PATENT DOCUMENTS

EP 0 561 497 A1 9/1993
JP H01-279581 A 11/1989
(Continued)

*Primary Examiner* — James Harvey
(74) *Attorney, Agent, or Firm* — Clarence R. Moon

(57) ABSTRACT

An electrical connector includes a housing having pockets formed in a receiving end of the housing. A terminal module is inserted into the pockets wherein the terminal modules are constructed from a stitch plate including a plurality of terminals retained therein, A cover having a plurality of spaced apart walls form thereon is arranged on the stitch plate and is moved into engagement with the stitch plate with the walls disposed in the intervening space between adjacent terminals. The connector assembly is pressed onto a circuit board in which a force is applied to the connector housing and is directly transferred to the terminal tails of the terminal modules causing electrical contact between conductive holes of the circuit board and the terminals.

19 Claims, 15 Drawing Sheets

(51) Int. Cl.

| | |
|---|---|
| ***H01R 4/48*** | (2006.01) |
| ***H01R 12/71*** | (2011.01) |
| ***H01R 43/20*** | (2006.01) |
| ***H01R 13/629*** | (2006.01) |
| ***H01R 12/00*** | (2006.01) |

(52) U.S. Cl.
CPC ..... *H01R 13/506* (2013.01); *H01R 13/62933* (2013.01); *H01R 43/20* (2013.01)

(56) References Cited

U.S. PATENT DOCUMENTS

| | | | | |
|---|---|---|---|---|
| 5,453,016 | A * | 9/1995 | Clark | H01R 43/205 439/79 |
| 5,504,989 | A | 4/1996 | Clark et al. | |
| 6,168,461 | B1 | 1/2001 | Chang | |
| 6,375,478 | B1 | 4/2002 | Kikuchi | |
| 6,719,587 | B2 | 4/2004 | Droesbeke et al. | |
| 7,190,589 | B2 | 3/2007 | Caines et al. | |
| 7,722,366 | B2 | 5/2010 | Yamamoto et al. | |
| 9,843,116 | B2 * | 12/2017 | Endo | H01R 12/585 |
| 2001/0005653 | A1 | 6/2001 | Belopolsky | |
| 2003/0166349 | A1 * | 9/2003 | Huss, Jr. | H01R 43/205 439/79 |
| 2006/0141831 | A1 | 6/2006 | Hsu | |
| 2007/0270042 | A1 | 11/2007 | Belopolsky | |
| 2007/0293100 | A1 | 12/2007 | Jakob et al. | |
| 2011/0281462 | A1 | 11/2011 | Takashi | |
| 2017/0187139 | A1 * | 6/2017 | Dekoski | H01R 13/506 |

FOREIGN PATENT DOCUMENTS

| | | | |
|---|---|---|---|
| JP | H06-062479 | U | 9/1994 |
| JP | H08-115766 | A | 5/1996 |
| JP | H10-199640 | A | 7/1998 |
| JP | 2003-257518 | A | 9/2003 |
| WO | WO 97/42686 | A1 | 11/1997 |

* cited by examiner

ELECTRICAL CONNECTOR WITH TERMINAL HOLDER

RELATED APPLICATIONS

This application claims priority to U.S. Provisional Application No. 62/005,279, filed May 30, 2014 which is incorporated herein by reference in its entirety.

FIELD OF THE INVENTION

The present disclosure relates to field of Vehicle Harness Connectors.

DESCRIPTION OF RELATED ART

The present disclosure generally relates to a modular connector system used in a vehicle. In general, connectors are suitable for use in vehicle systems including junction distribution blocks, power control modules and other body control systems. These systems typically employ a wire harness to connect the various body and control systems throughout the vehicle.

BRIEF SUMMARY

A connector system is provided that includes a plug connector and a receptacle connector. The connector system typically includes a plug connector assembly or header assembly including a plurality of electrical conducting terminals that are coupled to a printed circuit board and a receptacle connector assembly including a corresponding number of mating electrical terminals coupled to a wiring harness.

The header assembly is generally mounted on a printed circuit board within an electronics module. These modules involve a high number of circuits to accommodate all necessary electronics associated with these circuits. In order to mechanically connect the high number of circuits associated with these connector assemblies, a mechanical assist is required. Typically, a rotating or pivoting arm is used in conjunction with a cam or gear providing a mechanical advantage to multiply the applied force and thereby decrease the user input to properly mate the connectors together.

The terminals extend from the plug housing and are mounted to the circuit board in either a vertical, straight fashion or a right angle, bent fashion. The terminals are configured with tails that have a compliant section that engage a plated contact hole in a circuit board. As the terminals extend from the housing, a support plate and/or a terminal alignment plate are used to position the terminal tails in a prescribed fashion so that the terminals can be easily orientated and secured to corresponding contact areas on the circuit board.

The plug housing includes a molded exterior housing with pockets to retain a series of terminal modules. Each terminal module or pin holder assembly includes a stitch plate or pin biscuit for retaining the plurality of electrical terminals, an integrated pin support for aligning and supporting the tail portions of the electrical terminals, a tail aligner for maintaining the position of the securing portions of the terminal tails and a pin protection plate for preventing damage to the mating portions of the electrical terminals during the mating process. Once inserted into the housing, the complete assembly can be mounted to a circuit board by pressing the housing and in turn, the compliant tails into contact holes on the circuit board.

BRIEF DESCRIPTION OF THE DRAWINGS

The present disclosure is illustrated by way of example, and not limited, in the accompanying figures in which like reference numerals indicate similar elements and in which.

DETAILED DESCRIPTION

FIGS. 1-22 illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

Figure 1:
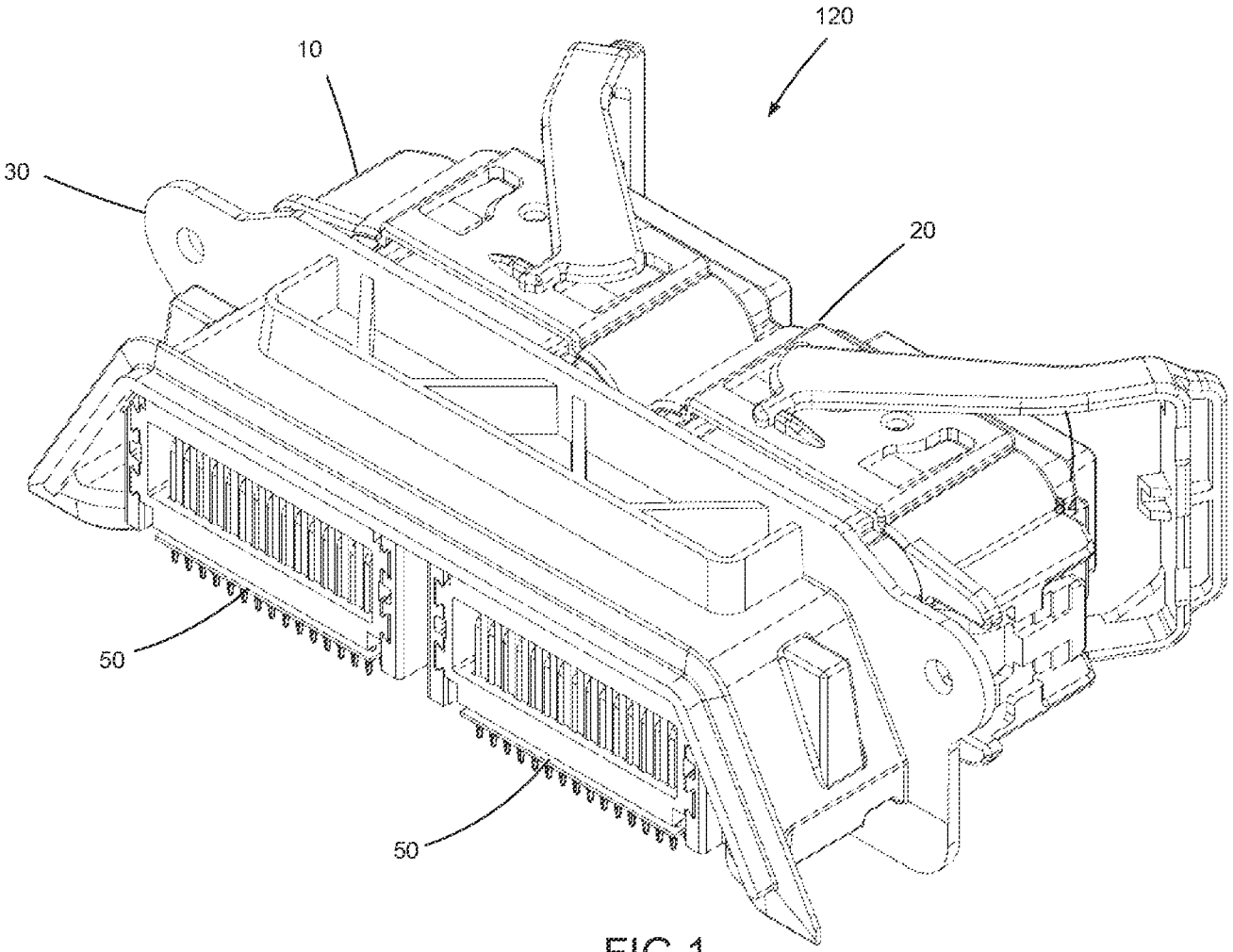
FIG. 1 is a perspective view of the vehicle harness connector.
Figure 2:
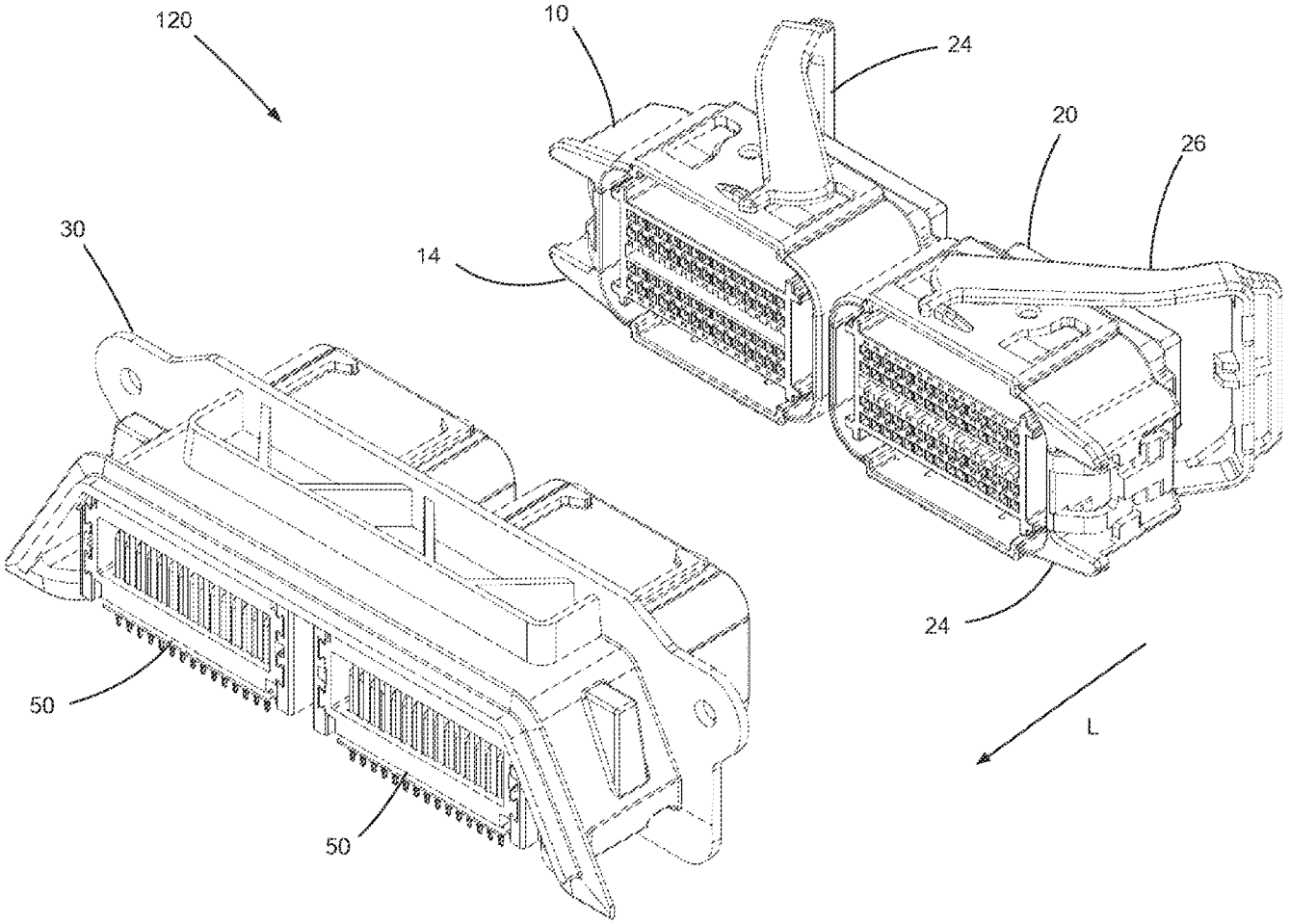
FIG. 2 is an exploded view of the vehicle harness connector of FIG. 1.
Figure 3:
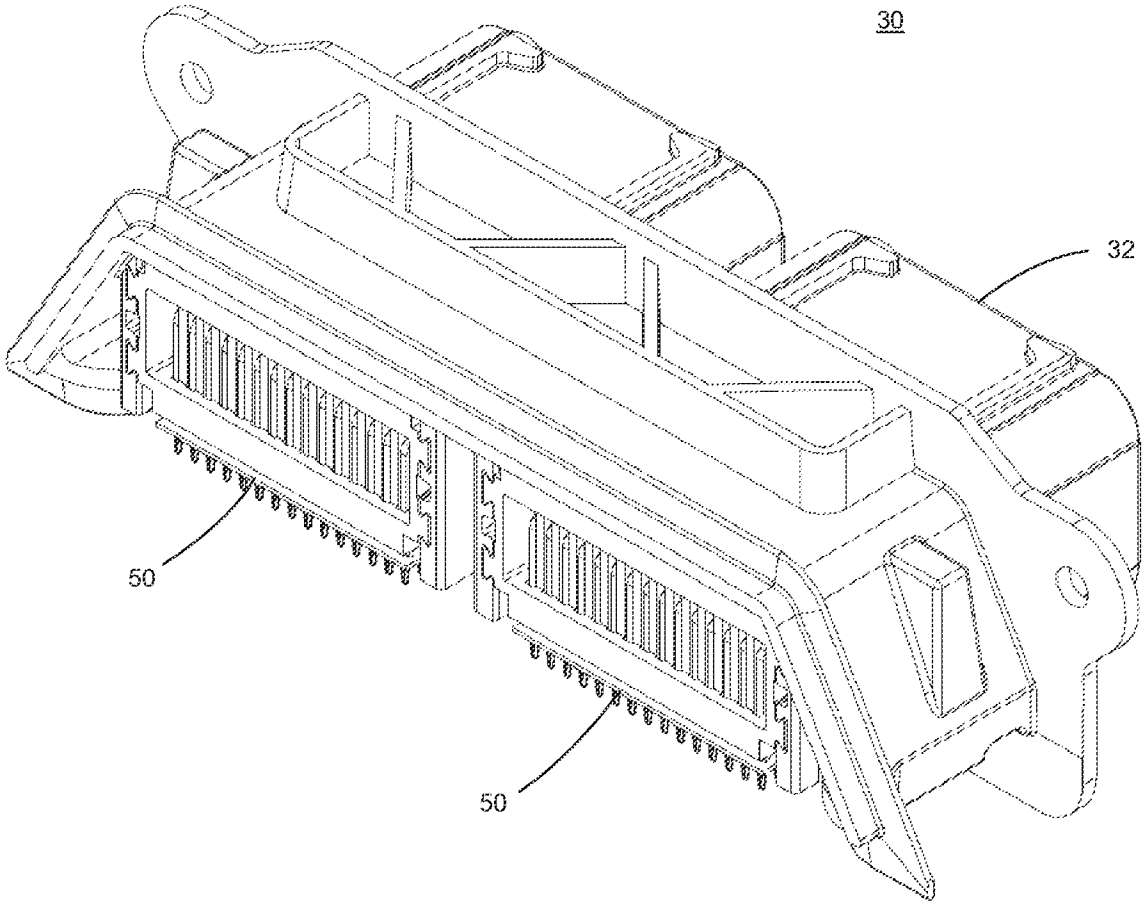
FIG. 3 is a perspective view of the receptacle connector of FIG. 1.

The connector system 120 as shown in FIGS. 1-3 includes a first connector 30 generally mounted to a printed circuit board (not shown) and a second connector 10, 20 for mating with the first connector 30 and generally forming an end of a vehicle wiring harness. The first connector or header 30 includes a housing formed from an insulative material with a first end for mating with a corresponding second connector or plug 10, 20 and a second end for receiving a terminal module 50. The terminal module 50 or pin holder assembly includes a stitch plate 80, a plurality of terminal pins 100, a mylar terminal tail aligner 110 and a cover 60.

As illustrated in FIGS. 1-4 the connector assembly 120 includes a first connector or header 30 formed from an insulative material. The housing 32 includes a front mating end 33 adapted to be coupled to a housing of a second connector or plug 10, 20 and a rear receiving end 35. The housing further includes an opening (not shown) extending from the mating end 33 to the receiving end 35. A pocket 34 is formed in the receiving end 35 of the housing 32 for securing the terminal module 50.

As shown in FIGS. 5-8 the terminal module includes a stitch plate 80, a plurality of terminals 100, an alignment plate 110 and a cover 60. The stitch plate 80 is molded from an insulative material with a plurality of cavities 82 formed therein in a generally rectangular array that includes several rows, in the embodiment shown four rows of cavities are shown. The stitch plate is generally "L" shaped having a front wall and a bottom wall with the terminal cavities 82 formed in the front wall. Each side of the stitch plate 80 has a boss 84 extending laterally with a tapered portion 85 formed at the distal end of the boss 84. The bottom wall includes a plurality of cavities 86 formed along an edge corresponding to the number of terminals 100 in a row.

Each cavity 82 receives a stamped and formed terminal pin 100. The terminal pins 100 are formed from an electrically conductive material such as copper, copper based material or any type of electrically conductive alloy or material. In the preferred embodiment the terminals are shown as square pins but round pins or blades can also be used. The terminal includes a body portion 103 with a tail 106 formed on one end of the body portion 103 and a retaining portion 104 on a second end of the body portion 103. The tails include a compliant section for engaging a conductive hole in a printed circuit board. In the embodiment shown, the compliant section is an "eye of the needle", EON configuration but other compliant connections can be appreciated. A contacting portion 102 extends at a distal end of the retaining portion 104. The retaining section includes an enlarged portion having a flat plate with a plurality barbs formed on the edges. The barbs provide retention of the terminal to the cavities 82 formed in the stitch plate 80. The barbs dig or skive into the walls of the cavity and secure the terminal therein.

Figure 8:
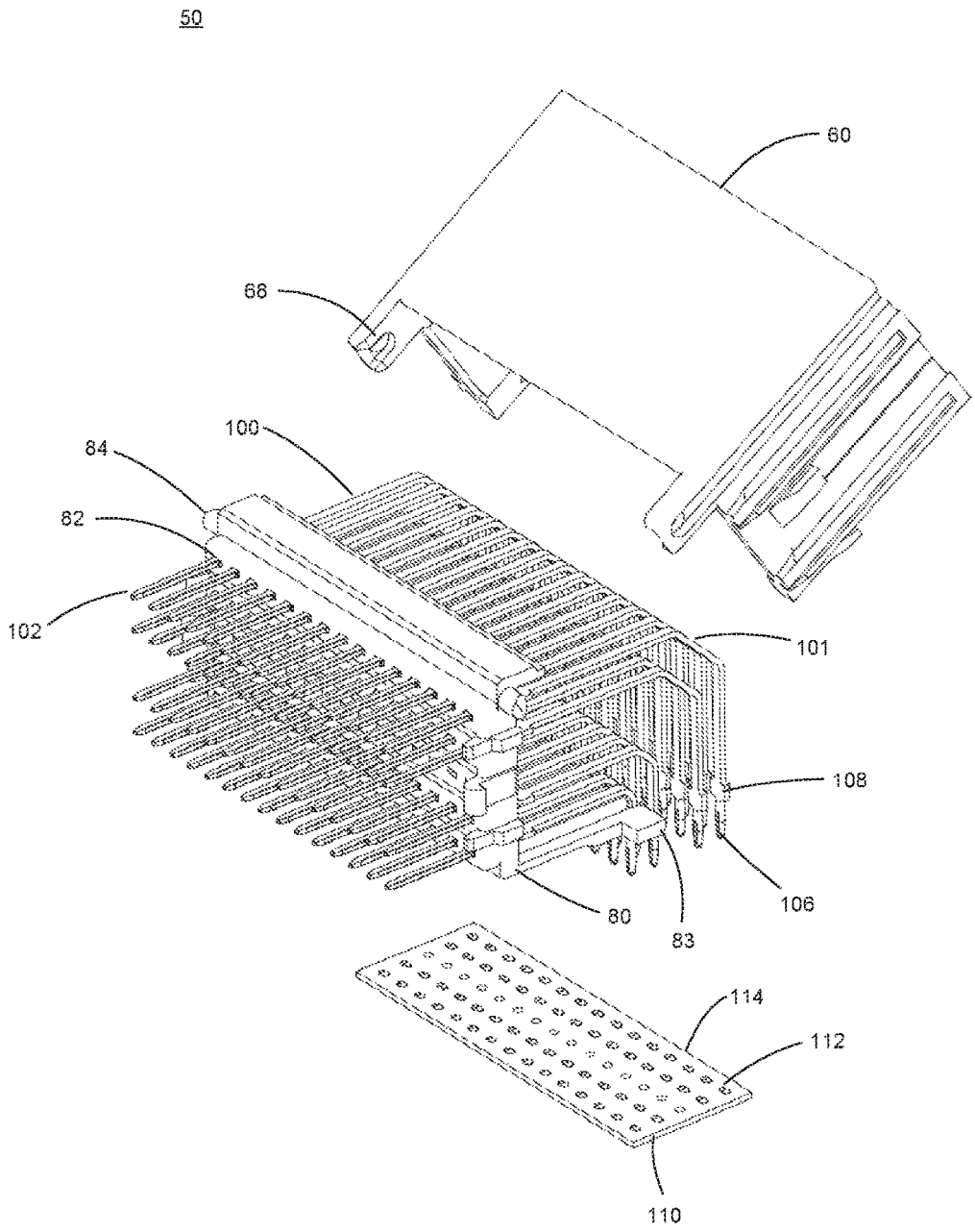
FIG. 8 is an exploded view of the terminal module of FIG. 6.

Adjacent the enlarged portion is an insertion portion 105 wherein the insertion portion 105 is used to connect adjacent terminals during the forming process. A carrier strip (not shown) connects the terminals 100 at the insertion portion 105 of the retaining portion 104 and is removed during assembly of the terminal to the stitch plate 80. The insertion portion 105 includes a shoulder that engages the assembly tool during the insertion of the terminals. The tool is clamped to the terminals 100 with the tool engaging the shoulder of the insertion portion. With all the terminals 100 clamped in the tool, the contacting portion 102 is inserted through the cavities 82 and upon further insertion, the barbs dig into the housing securing the terminals 100 in place. As illustrated in FIG. 8, once the terminals 100 have been fully inserted into the stitch plate 80, the terminals 100 are formed or bent transversely 90 degrees to the contacting portion 102. The bent portion 102 connects joins the horizontal portion to the vertical portion of the formed terminal 100.

As further illustrated in FIG. 8, an alignment plate 110 is disposed on the tails 106 of the terminals 100. The alignment plate 110 is formed from an insulative material such as Mylar by generally by stamping. Once the terminals 100 are formed to the 90 degree state a plurality of holes 112 formed in rows are aligned with the tails 106 and slid over the tails 106. The tails 106 pass through the holes 112 and a portion of the alignment plate 114 presses against the pressing section 108 of the terminals 100. The alignment plate 110 maintains the true position of the tails 106 prior to insertion into the printed circuit board.

Figure 20:
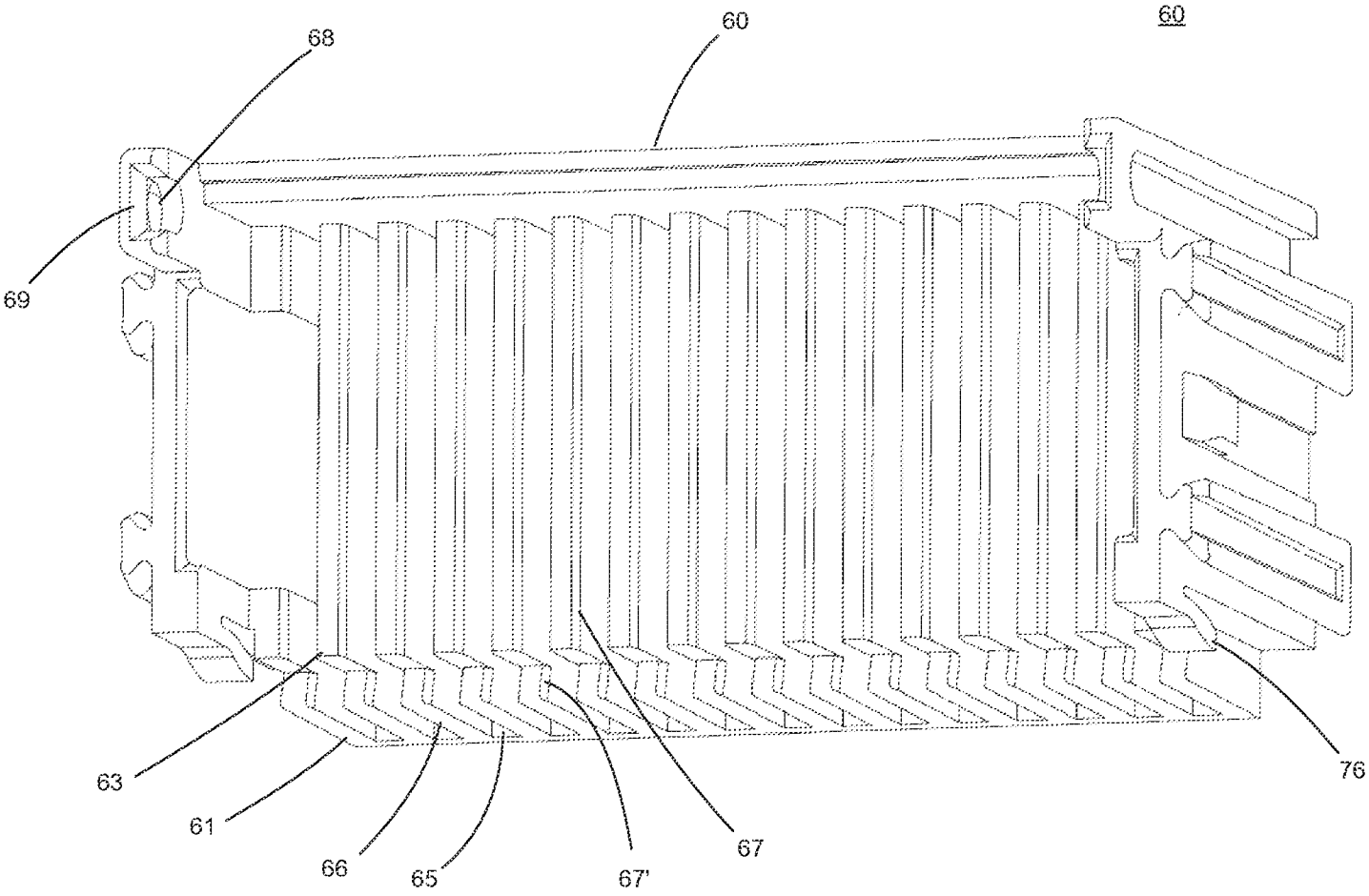
FIG. 20 is a perspective view of the cover of the terminal module of the disclosure.

To complete the terminal module assembly 50, a cover 60 is secured to the populated stitch plate 80. As best shown in FIG. 20 the cover 60 is formed from an insulative material and is configured to cover the bent terminals 100 secured to the stitch plate 80. The cover 60 includes a pair of side walls and a top wall connecting the side walls. The interior of the cover 60 includes a plurality of spaced apart walls 66 with a space or opening 65 defined between adjacent walls 66. The bottom of each wall 66 includes a cutout portion that engages the bottom wall of the stitch plate 80 so that the bottom wall of the stitch plate 80 and the bottom surface of the walls 66 are coplanar. Each interior wall 66 includes a pair of adjacent ends portions 61, 63 that join each other at the cutout. The lower end portion 61 has a flat surface that corresponds to the entire wall thickness and the second end portion 63 includes a bevel 67 formed on each side of the wall 66. Additionally, a journal 68 having a tapered lead-in portion 69 is formed on each of the side walls of the cover 60.

Figure 9:
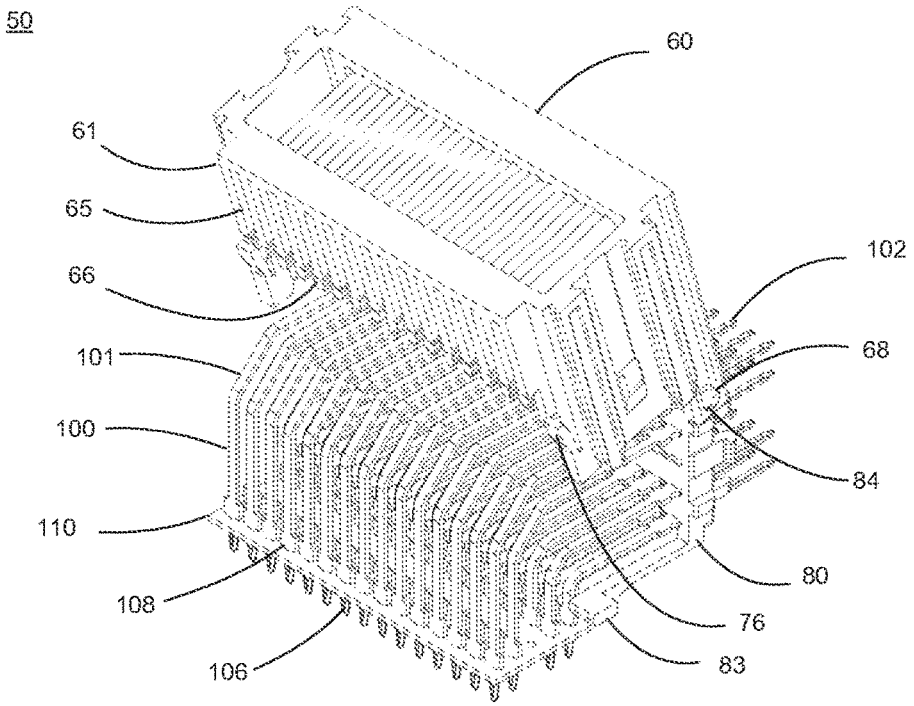
FIG. 9 is a perspective view of the terminal module with the cover in first position of assembly sequence.

The assembly sequence for positioning the cover from a first position in which the cover is attached to the stitch plate and the final position in which the cover is latched in its final position is illustrated in FIGS. 9-18. The journals 68 in the cover 60 are aligned with the bosses 84 formed in the stitch plate 60 with the tapered lead-in portion 69 of the journals 68 engaging the tapered portion 85 of the boss 84. The journals 68 are pressed toward the bosses 84 causing the walls of the cover where the journals 68 are formed to deflect outward and slide over the bosses 84 with the journals 68 snapping back over the bosses 84 allowing the cover 60 to be pivotably attached to the stitch plate 60 as best depicted in FIG. 9.

Figure 10:
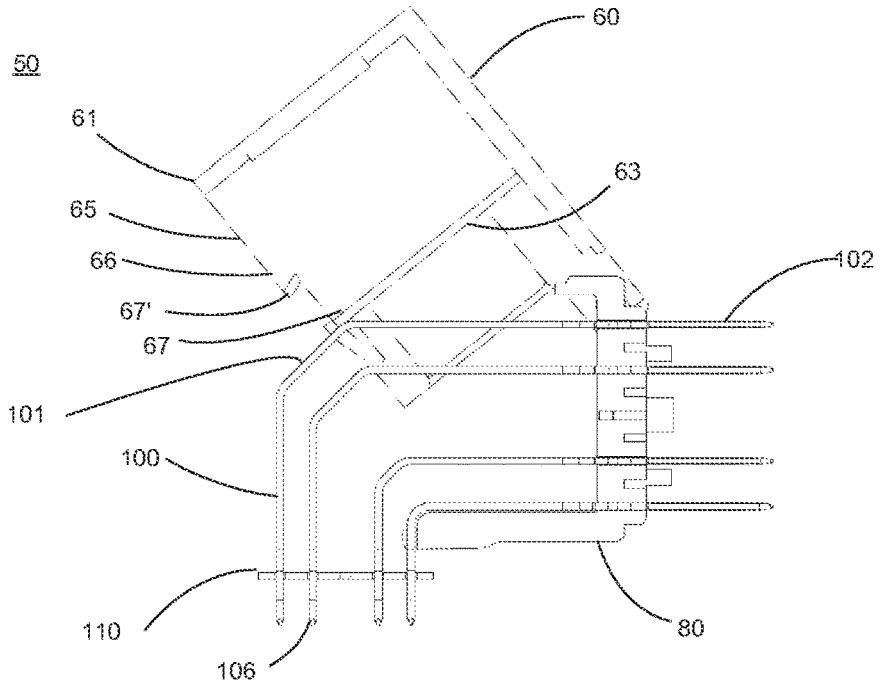
FIG. 10 is a section view of the terminal module of FIG. 9.
Figure 11:
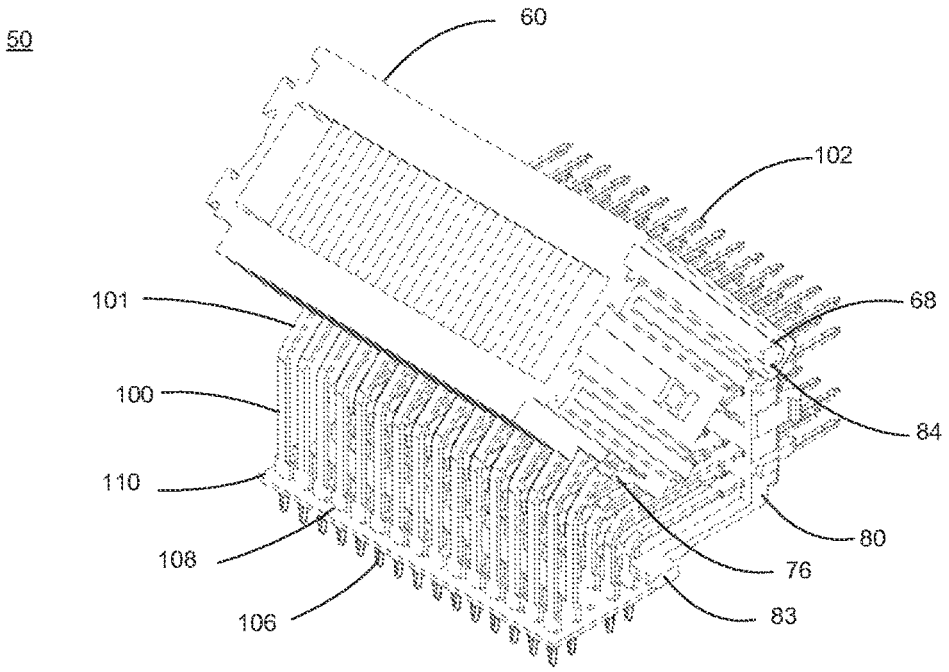
FIG. 11 is a perspective view of the terminal module with the cover in an intermediate position of assembly sequence.
Figure 12:
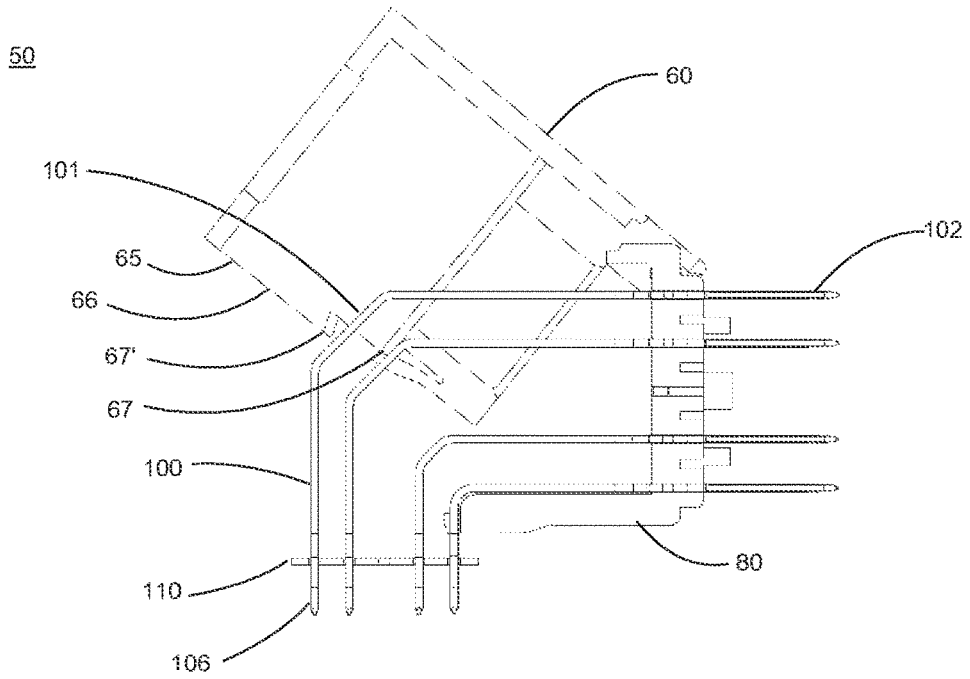
FIG. 12 is a section view of the terminal module of FIG. 11.
Figure 13:
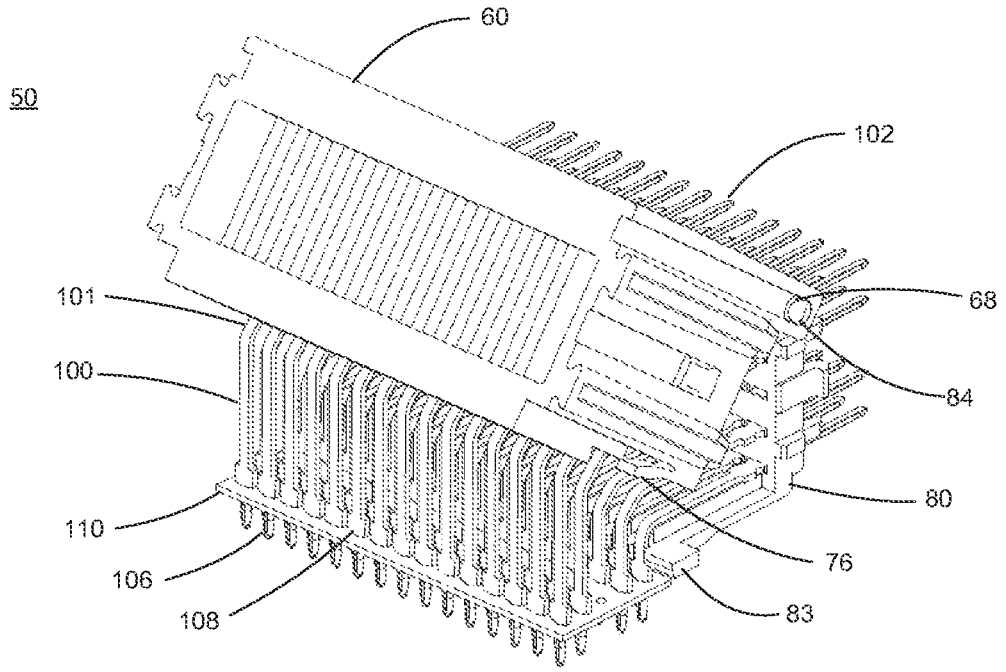
FIG. 13 is a perspective view of the terminal module with the cover in an intermediate position of assembly sequence.
Figure 14:
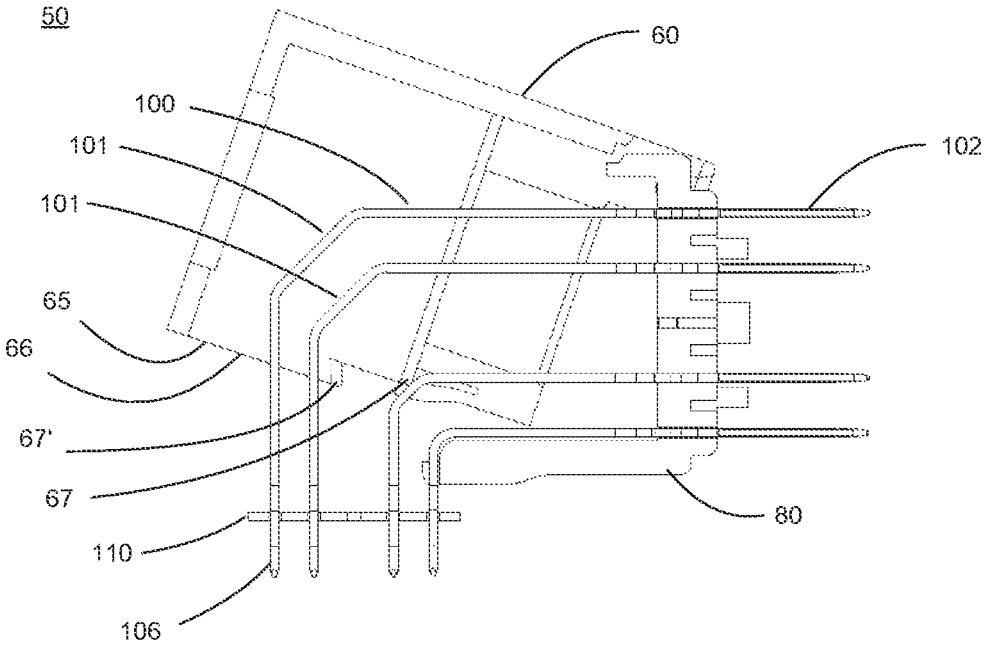
FIG. 14 is a section view of the terminal module of FIG. 13.
Figure 15:
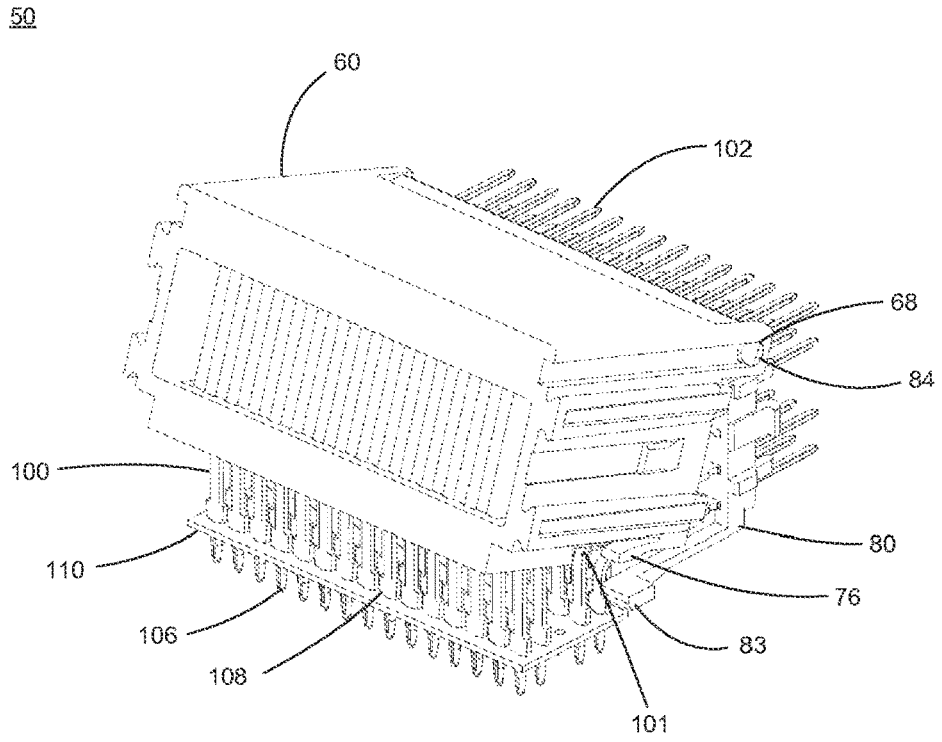
FIG. 15 is a perspective view of the terminal module with the cover in an intermediate position of assembly sequence.
Figure 16:
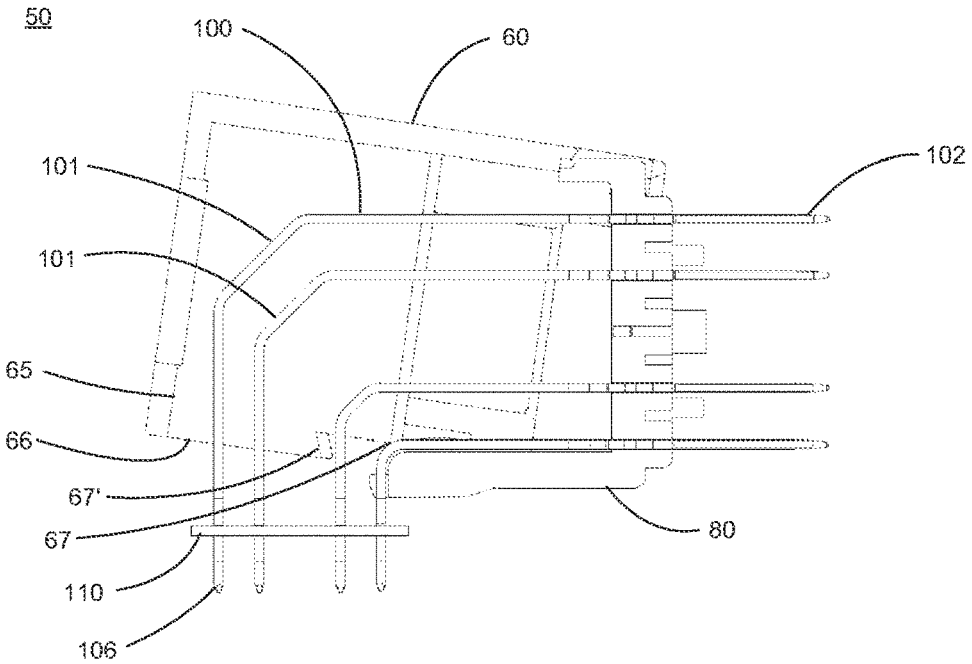
FIG. 16 is a section view of the terminal module of FIG. 15.

Once the cover 60 is attached to the stitch plate 80, the cover is rotated from a first position, from which it was installed to a final seated position, in which the seating sequence involves the walls 66 of the cover 60 to be disposed between adjacent terminals 100 and the terminals 100 positioned within the openings 65. As depicted in FIGS. 9 and 10 as the cover is rotated the walls 66 are translated through the terminals 100, the bevel 67 formed on the end 63 guides the wall 66 into place past the bent portion 101 of the terminal 100 therefore eliminating any stubbing that could occur between the wall 66 and the terminal 100.

Figure 21:
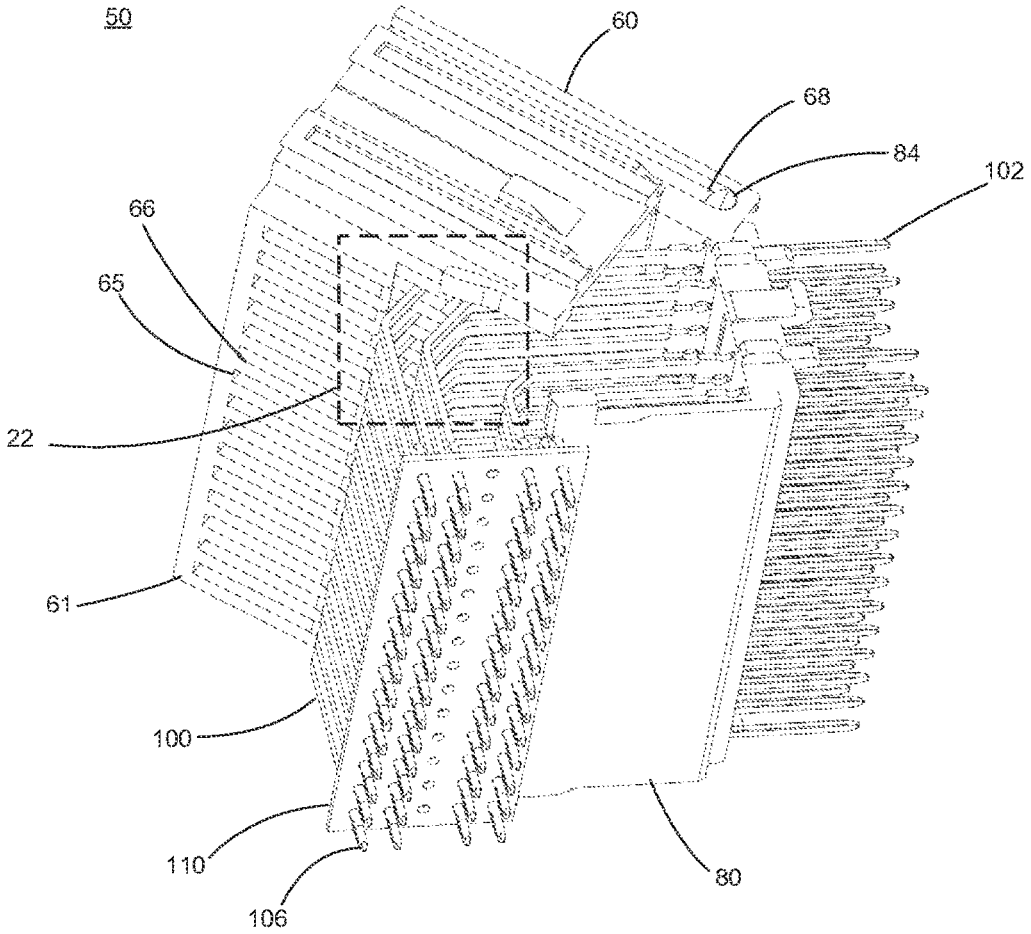
FIG. 21 is a side perspective of the terminal module with the cover in an intermediate position during the assembly sequence.
Figure 22:
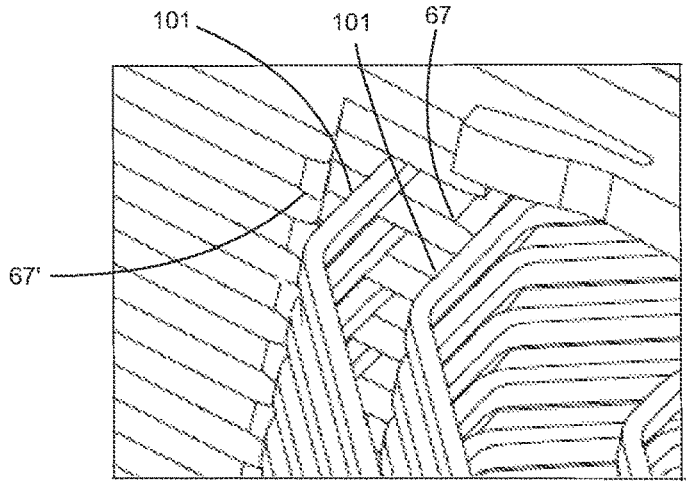
FIG. 22 is a detail view.

As further depicted in FIGS. 11-16 the cover 60 is advanced past the rows of terminals 100 with the bevel 67 of the ends 63 of the walls 66 successively passing the rows of terminals 100 wherein the bevel preventing any stubbing between the walls 66 and the terminals 100. Additionally, the cutout portion forms a jog in the wall creating a partial end corresponding to the end 63 in wall 66 but in a spaced apart relationship. The partial end also includes a bevel 67' formed in its respective end as shown in FIGS. 21 and 22. This portion also successively passes the rows of terminals 100 without stubbing as described above.

Figure 17:
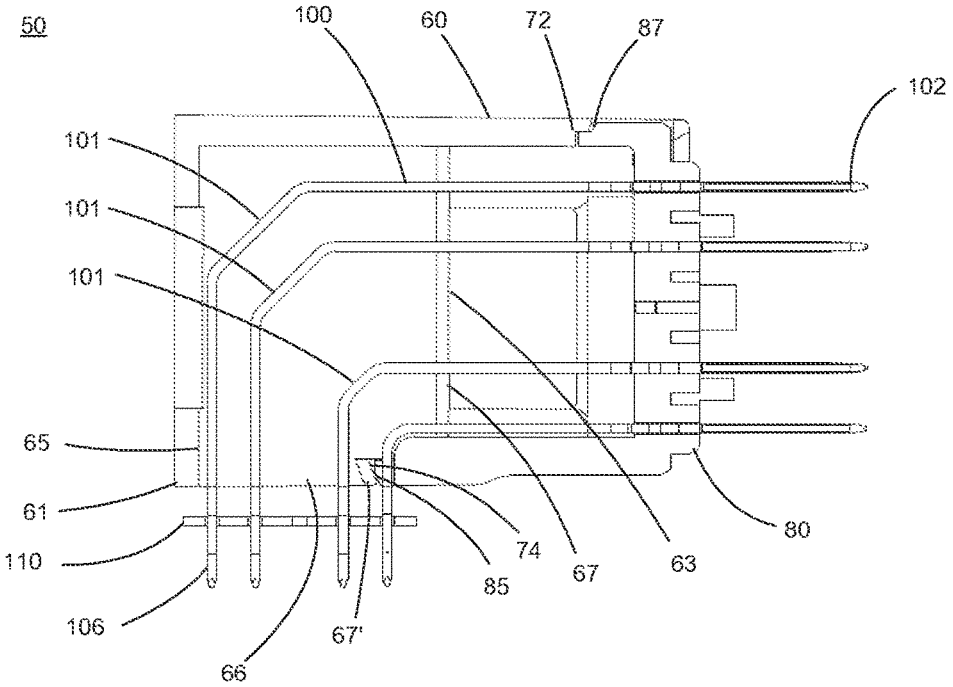
FIG. 17 is a section view of the terminal module with the cover in the final position of assembly sequence.
Figure 18:
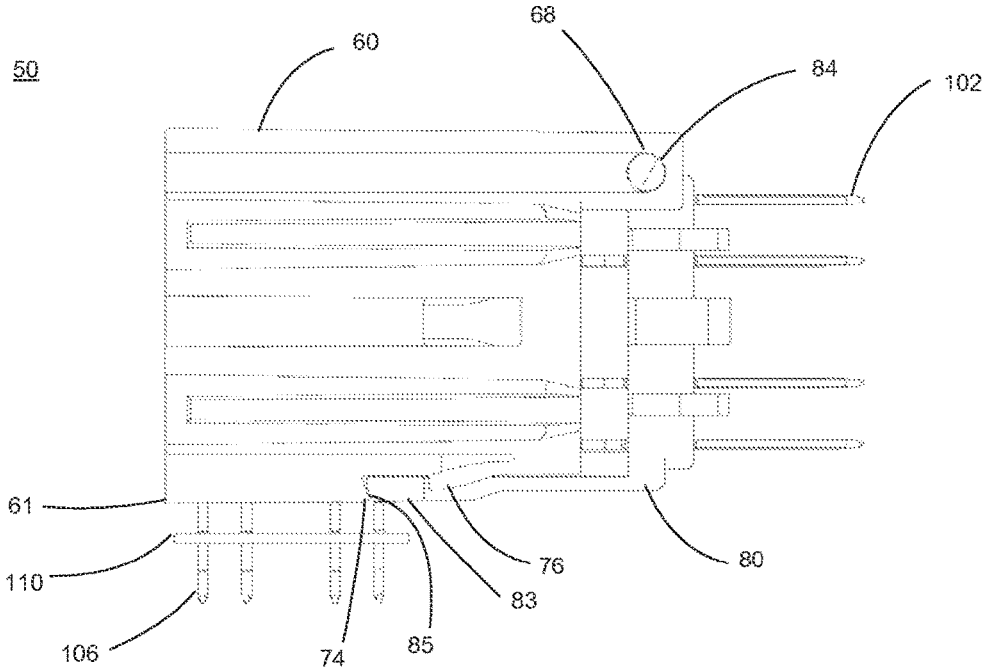
FIG. 18 is an end view of the terminal module of FIG. 5.
Figure 19:
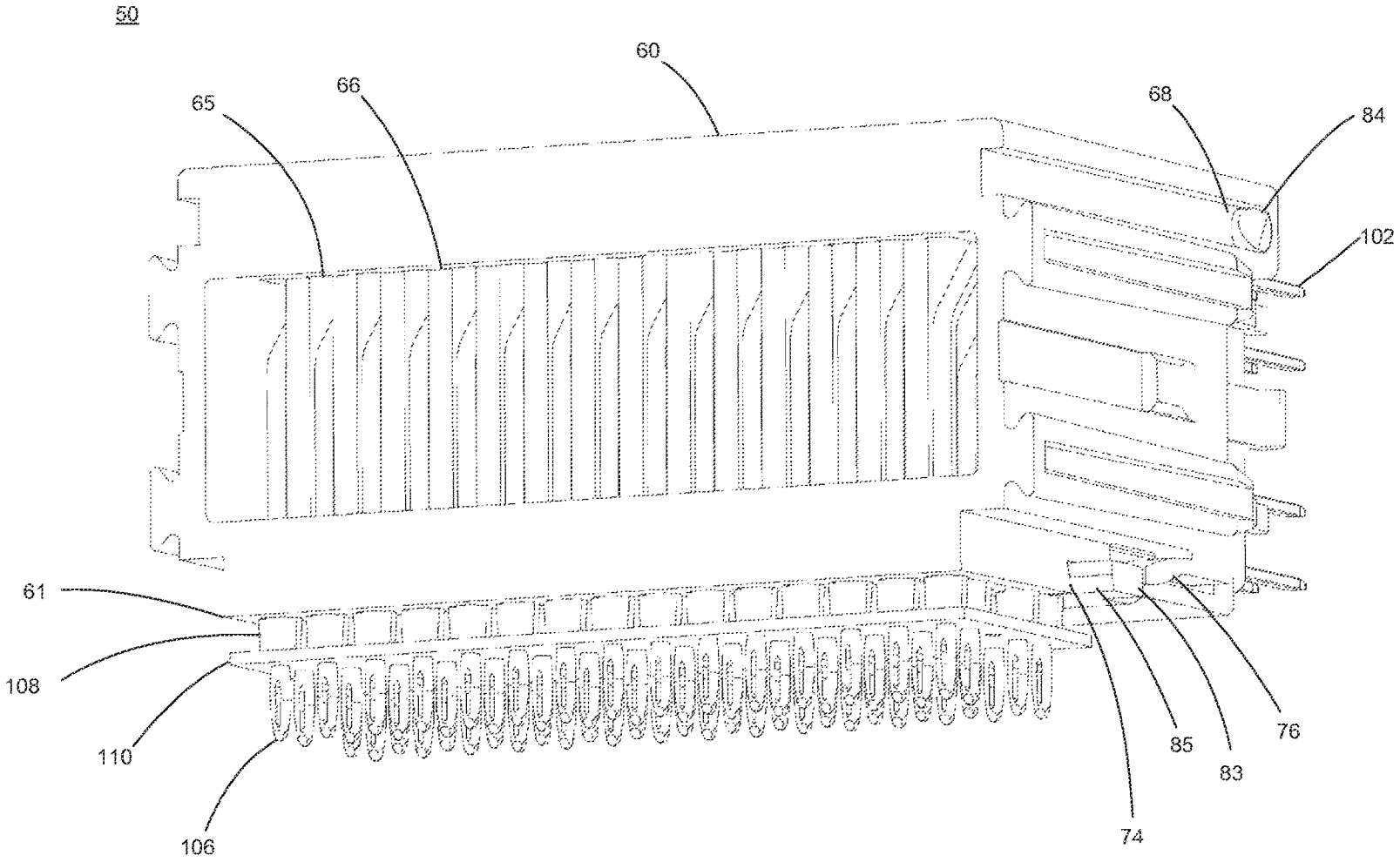
FIG. 19 is a rear perspective view of the terminal module of FIG. 5.

As best shown in FIGS. 17-19, the cover 60 is shown in the final position in which the end 61 is coplanar with the bottom surface of the stitch plate 80. In this position a tapered portion 74 formed on the bottom of the cover 60 engages a cooperating tapered surface 85 formed on a flanged 83 on the bottom of the stitch plate 80. As further illustrated in FIG. 17, a pair of interlocking lips 72, 87 engage each other in an overlapping manner. Together, both the upper and lower tapered portions 74, 85 and 72, 87 secure the cover 60 to the stitch plate 80 wherein the tapered portions create a tight fit between the cover 60 and the stitch plate 80 and minimized the possibility of slop or shifting between them. Additionally, the flange 83 that is formed on the stitch plate 80 engages a deflectable latch 76 formed on the cover 60 to retain the cover 60 in the final position.

The further illustrate the assembly process, with the alignment plate 110 previously attached to the tails 106 of the terminals 100, the embodiment shown has the cover 60 attached to bosses 84 formed on each side of the stitch plate 80. This allows the cover 60 to pivot about the boss 84 and the cover 60 to be attached without pre-aligning the walls 66 to the columns of terminals 100 while being secured to the stitch plate 80. Once attached, the cover 60 is then pivoted to a second or final position where it is locked in place as described above. Each end portion 63 of wall 66 has a bevel 67 or chamfer formed on the end portion 63 to allow the walls 66 to be easily guided between the columns of terminals 100. As the cover 60 is further rotated to its final position the walls 66 are threaded between adjacent columns of terminals 100 and the walls 66 pass the rows of terminals 100 as it is pivoted to its final position.

Once the cover 60 is in its final position, the lower end portion 61 of the walls 66 of the cover 60 or the edge nearest the alignment plate 110 engages the pressing section 108 of the terminals 100 as best illustrated in FIG. 19. This allows the lower end portion 61 of the walls 66 to be in direct engagement and to press against the pressing section 108 of the terminals 100. The lower end portions 61 of the walls do not require any lead in or chamfer due to the pivoting of the cover 60, that is, the cover 60 is essentially moved into the final position from the side of the terminal 100 at an angle and guided by the bevel 67 of the end portion 63 of the wall 66 until the lower end portion 61 of wall 66 engages the pressing section 108 of the terminals 100 therefore maximizing the support between the pressing section 108 and the lower end portion 61.

Figure 4:
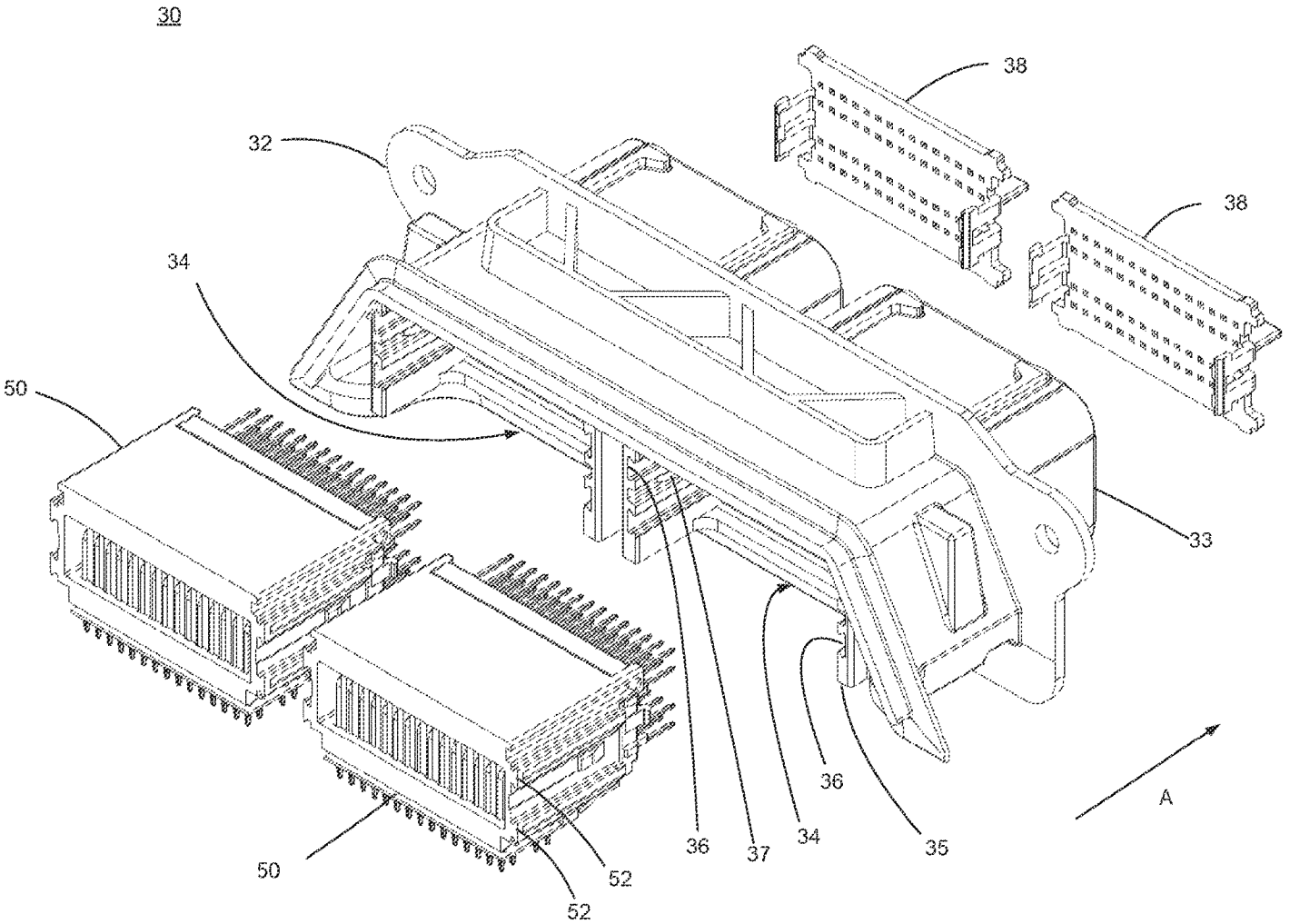
FIG. 4 is an exploded view of the receptacle connector of FIG. 3.
Figure 5:
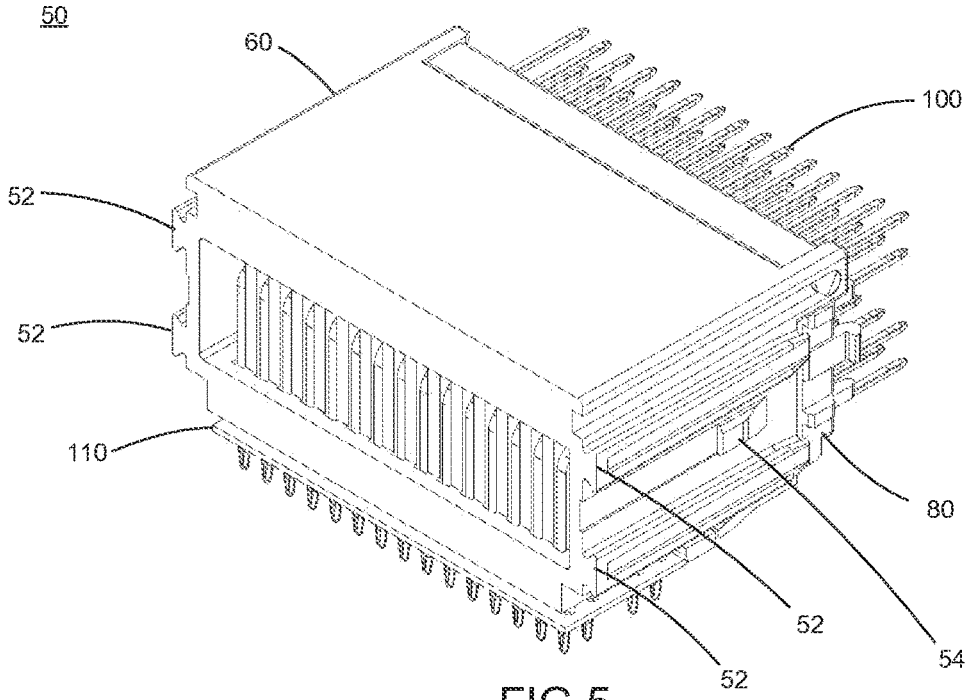
FIG. 5 is a perspective view of a terminal module of the disclosure.
Figure 6:
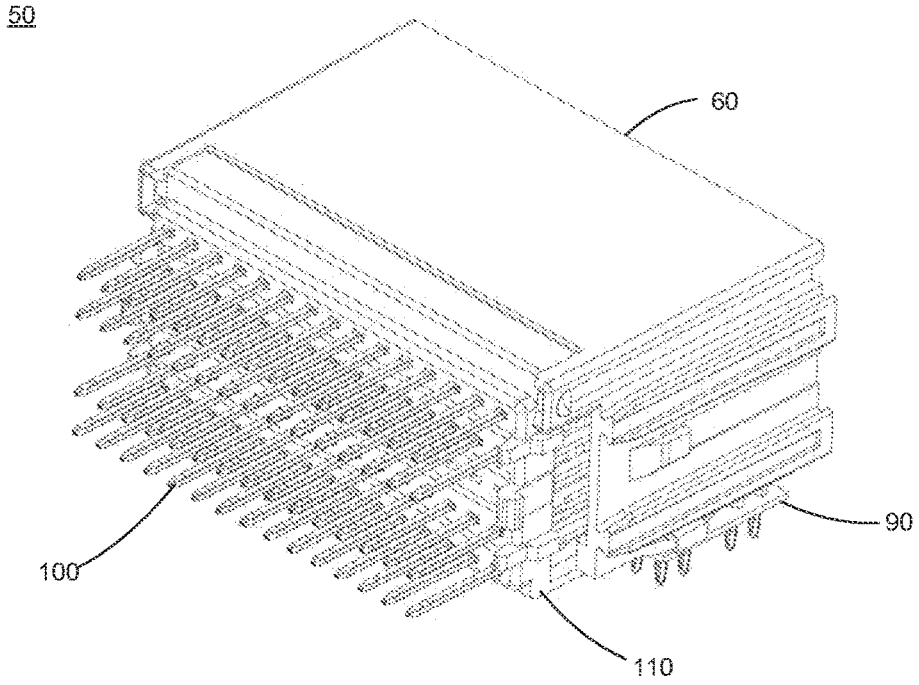
FIG. 6 is an alternative perspective view of the terminal module of FIG. 5.
Figure 7:
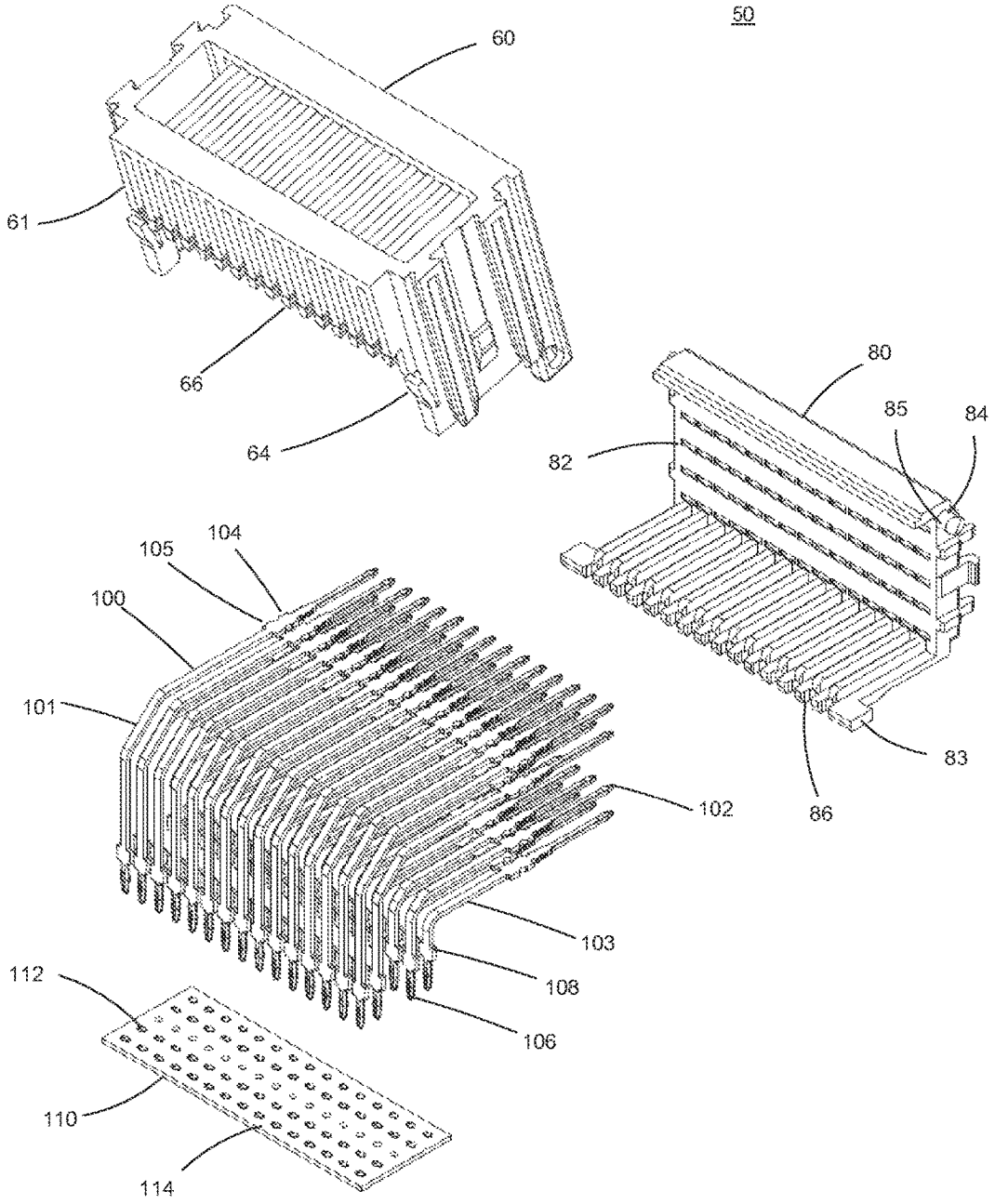
FIG. 7 is an exploded view of the terminal module of FIG. 5.

Once each terminal module assembly 50 is completely assembled, each terminal module 50 is inserted into the first connector housing 32 along an insertion direction A as shown in FIGS. 4-6. The terminal module 50 includes a cover 60 plate having a pair of guiding ribs 52 formed on each of the lateral sides of the cover 60. The guiding ribs 52 are tapered along the insertion direction A and are inserted into corresponding slots or guide-ways 36 that are also tapered formed in each pocket 34 formed in the receiving end 35 of the housing and secured by a locking ramp 54 formed in the cover 60 and shoulder 37 formed in the pocket 34. In the embodiment the guiding ribs 52 and guide-ways 36 are general in the form of "dove tail" joint, it can be appreciated that other joints such as a "T" or other geometrical configuration can be used. The corresponding tapers allow the guiding ribs 52 and the guide-ways 36 to fit together in a wedging manner without any slop or a loose fitting condition. In the embodiment shown, there are two terminal assemblies 50 inserted into the first connector housing 32. A pin stabilizing plate 38 is attached to the mating end 33 of the housing 32 completing the connector assembly 30. As previously described, a tail aligner 110 is arranged on the tails 106 of the terminals 100 and provides a final positioning measure in addition to the cover 60. The tail aligner 110 maintains the true position of the tails 106 so that the pin tail array of the terminal module 50 corresponding to the respective hole pattern on the printed circuit board are properly aligned prior to pressing the connector assembly 30 to the printed circuit board.

Once the terminal assemblies 50 are inserted into the housing 32 the entire connector assembly 30 is assembled to the printed circuit board (not shown). Each of the electrical terminals 100 has a corresponding tail 106 that is pressed into a conductive hole in the circuit board. The tails 106 have a compliant portion, in this case an eye of the needle, "EON" type configuration that in operation conforms to the plated hole in the circuit board and maintains an outwardly directed force to maintain electrical contact between the conductive pad on the circuit board and the tail 106 of each terminal 100. Upon assembly, the upper surface of the connector housing 32 is pressed downward which, in turn, transfers the insertion force through the housing to the pin holder assemblies and subsequently to the support edge on each terminal. The connector is continually pressed downward until the bottom surface of the pin support engages the top abutting surface of the printed circuit board. The fact that the fits between the cover 60, stitch plate 80 and the terminal pressing section 108 and additionally between the terminal module 50 and connector housing 32 are in tight fitting engagement the no slop is introduced between these components and essentially the force applied to the connector housing 32 is directly transferred to the tails during the seating of the connector assembly to the circuit board.

A second connector or plug 10, 20 is provided and mates with the first end of the first connector 30 as shown in FIG. 2. The second connector includes a second housing 12, 22 molded from an insulative material and including an opening for accommodating the mating portion of the first connector 30. A plurality of second electrical terminals (not shown) is retained in cavities formed in the housing 14, 24 for electrically engaging corresponding terminals 100 of the first connector 30. A mechanical assist mechanism is mounted on the second connector including a pair of levers 16, 26 with corresponding pinion gears and a cam for providing a reduced mating force so that the first 30 and second connectors 10, 20 can be connected together with a minimized amount of user input force.

The assist mechanism is assembled to the second connector in a first position whereby the first connector and second connector can be brought into preliminary engagement. At this point, the levers are in an open or retracted position, the cam portions on the lever and pinion are in preliminary engagement with a cam groove formed on the first connector housing. In operation, the levers are pivoted to the second position, whereby the first and second connectors are in the fully mated position. During this movement, the cams are pivoted about their rotation axis allowing the tips or ends of each cam lobe to engage an inner surface of respective cam grooves. As the levers are advanced, the cam lobe tips impart an upward or downward force to the cam grooves and consequently move the second connector in a mating or un-mating direction L. The mating assist mechanism provides both the mating and un-mating force required to either engage or dis-engage the connector assembly.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

We claim:

1. A terminal holder comprising:

a stitch plate, the stitch plate having two rows of terminal cavities;

a plurality of terminals, the terminals positioned in the two rows of cavities, each terminal having a body portion with a tail on one end and a retaining portion on a second end, the retaining portion including a contact portion at a distal end, the body portion being bent and the tail includes a pressing section;

an aligning plate having two rows of holes configured to allow the tails to pass through the holes so that the pressing section presses against the aligning plate; and a cover pivotably attached to the stitch plate, the cover having walls and an intervening space defined between adjacent walls, the walls including an end having a flat surface, wherein the walls are disposed between adjacent terminals and the flat surface engages a portion of the pressing section.

2. The terminal holder of claim 1, wherein the wall includes a second end having a beveled surface.

3. A method for producing a connector comprising:

providing a housing having a mating end and a receiving end;

providing a stitch plate with a plurality of cavities;

providing a plurality of terminals having a body portion with a tail on one end and a retaining portion on a second end, the retaining portion including a contact portion at a distal end and the tail includes a pressing section;

inserting the terminals in the stitch plate;

providing a cover having a plurality of spaced apart walls;

forming a terminal module by attaching a cover to the stitch plate and locating the walls between adjacent terminals with a surface of the wall pressing against the pressing section of the terminal; and inserting the terminal module into the receiving end of the housing.

4. The terminal holder of claim 1, wherein the cover includes a journal and the stitch plate includes a boss that is disposed in the journal.

5. The terminal holder of claim 1, wherein the terminal holder has more than two rows of terminals.

6. The terminal holder of claim 5, wherein the terminal holder has four rows of terminals.

7. The terminal holder of claim 1, wherein the tails include a compliant section.

8. The terminal holder of claim 7, wherein the compliant section is an eye of the needle geometry.

9. A connector comprising:

a housing configured to mate with a housing of a second connector, the housing including a mating end and a receiving end and an opening connecting the mating end and the receiving end together, the receiving end including a pocket having a pair of opposing side walls and a guide-way formed in each of the side walls;

a terminal holder having a stitch plate and a cover attached to the stitch plate, a plurality of terminals arranged in two rows and retained in the stitch plated, each terminal having a body portion with a tail on one end and a retaining portion on a second end, the retaining portion including a contact portion at a distal end, the body portion being bent and the tail includes a pressing section, the cover having a plurality of spaced apart walls that are disposed between adjacent terminals with a portion of the wall engaging the pressing section, the cover further including a guide wherein the terminal holder is disposed in the pocket and the guide disposed in the guide-way.

10. The connector of claim 9, wherein the walls have a second portion having a beveled surface.

11. The connector of claim 10, wherein the portion of the wall is adjacent the second portion.

12. The connector of claim 9, wherein the terminal holder includes an aligning plate for aligning the tails and pressing against the pressing section.

13. The connector of claim 9, wherein the cover is pivotably attached to the stitch plate.

14. The connector of claim 13, wherein the cover includes a journal and the stitch plate includes a boss that is disposed in the journal.

15. The connector of claim 9, wherein the tails include a compliant section.

16. The connector of claim 9, wherein the terminal module is locked to the housing.

17. The connector of claim 9, wherein the guide and the guide-way is a tapered dovetail.

18. The method for producing a connector of claim 3, wherein the cover is attached to the stitch plate in a pivoting manner.

19. The method for producing a connector of claim 18, wherein the stitch plate is provided with a boss and the cover is provided with a journal.

* * * * *